US011361897B2

(12) United States Patent
Yan et al.

(10) Patent No.: US 11,361,897 B2
(45) Date of Patent: Jun. 14, 2022

(54) INTEGRATED MULTI-PHASE NON-COUPLED POWER INDUCTOR AND FABRICATION METHODS

(71) Applicant: EATON INTELLIGENT POWER LIMITED, Dublin (IE)

(72) Inventors: Yipeng Yan, Shanghai (CN); Jinliang Xu, Shanghai (CN); Dengyan Zhou, Shanghai (CN); Jin Lu, Jiangsu (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 944 days.

(21) Appl. No.: 15/964,243

(22) Filed: Apr. 27, 2018

(65) Prior Publication Data

US 2019/0295765 A1 Sep. 26, 2019

Related U.S. Application Data

(63) Continuation of application No. PCT/CN2018/079818, filed on Mar. 21, 2018.

(51) Int. Cl.

*H01F 3/14* (2006.01)
*H01F 27/28* (2006.01)
*H01F 27/29* (2006.01)

(52) U.S. Cl.

CPC ..... *H01F 27/2823* (2013.01); *H01F 27/29* (2013.01)

(58) Field of Classification Search

CPC .... H01F 27/2823; H01F 27/29; H01F 27/292; H01F 27/2852; H01F 27/263; H01F 27/306; H01F 37/00; H01F 3/14

See application file for complete search history.

(56) References Cited

U.S. PATENT DOCUMENTS

| | | | | |
|---|---|---|---|---|
| 4,597,169 | A * | 7/1986 | Chamberlin | H01F 21/08 29/605 |
| 6,414,582 | B1 * | 7/2002 | Brkovic | H01F 38/023 336/185 |
| 6,774,758 | B2 * | 8/2004 | Gokhale | H01F 3/14 336/110 |
| 7,352,269 | B2 * | 4/2008 | Li | H01F 17/04 336/170 |
| 7,525,406 | B1 * | 4/2009 | Cheng | H01F 17/043 336/232 |
| 7,898,379 | B1 | 3/2011 | Stratakos et al. | |
| 9,251,944 | B2 * | 2/2016 | Hsieh | H01F 27/2823 |
| 2004/0113741 | A1 | 6/2004 | Li et al. | |
| 2005/0012583 | A1 * | 1/2005 | Sutardja | H01F 37/00 336/178 |

(Continued)

OTHER PUBLICATIONS

International Search Report for International Application No. PCT/CN2018/079818; dated Nov. 13, 2018; 9 pages.

*Primary Examiner* — Mang Tin Bik Lian
(74) *Attorney, Agent, or Firm* — Armstrong Teasdale LLP

(57) ABSTRACT

A multi-phase integrated power inductor component assembly includes a plurality of conductive windings on an integrated magnetic core structure accepting each of the plurality of conductive windings in a spaced apart, non-coupled arrangement with respect to one another. The integrated magnetic core structure includes a series of magnetic gaps each being respectively centered on one of the plurality of conductive windings. The windings include surface mount terminations for connection to a circuit board.

21 Claims, 7 Drawing Sheets

(56) References Cited

U.S. PATENT DOCUMENTS

| | | | | |
|---|---|---|---|---|
| 2006/0089022 | A1* | 4/2006 | Sano | H01F 17/06 439/79 |
| 2006/0145800 | A1* | 7/2006 | Dadafshar | H01F 27/2847 336/82 |
| 2007/0252669 | A1* | 11/2007 | Hansen | H01F 27/255 336/212 |
| 2009/0231081 | A1* | 9/2009 | Ikriannikov | H02M 7/003 336/222 |
| 2010/0013587 | A1* | 1/2010 | Yan | H01F 27/306 336/192 |
| 2012/0300500 | A1* | 11/2012 | Ikriannikov | H01F 30/06 363/16 |
| 2016/0276087 | A1* | 9/2016 | Yan | H01F 27/292 |
| 2017/0178784 | A1 | 2/2017 | Janis et al. | |
| 2017/0178794 | A1 | 6/2017 | Yan et al. | |

* cited by examiner

INTEGRATED MULTI-PHASE NON-COUPLED POWER INDUCTOR AND FABRICATION METHODS

CROSS REFERENCE TO RELATED APPLICATIONS

This application is a continuation application of International Application No. PCT/CN2018/079818.

BACKGROUND OF THE INVENTION

The field of the invention relates generally to electromagnetic inductor components, and more particularly to a power inductor component for circuit board applications including a plurality of windings that are not magnetically coupled.

Power inductors are used in power supply management applications and power management circuitry on circuit boards for powering a host of electronic devices, including but not necessarily limited to hand held electronic devices. Power inductors are designed to induce magnetic fields via current flowing through one or more conductive windings, and store energy via the generation of magnetic fields in magnetic cores associated with the windings. Power inductors also return the stored energy to the associated electrical circuit by inducing current flow through the windings. Power inductors may, for example, provide regulated power from rapidly switching power supplies in an electronic device. Power inductors may also be utilized in electronic power converter circuitry.

Power inductors are known that include multiple windings integrated in a common core structure. Existing power inductors of this type however, are problematic in some aspects and improvements are desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
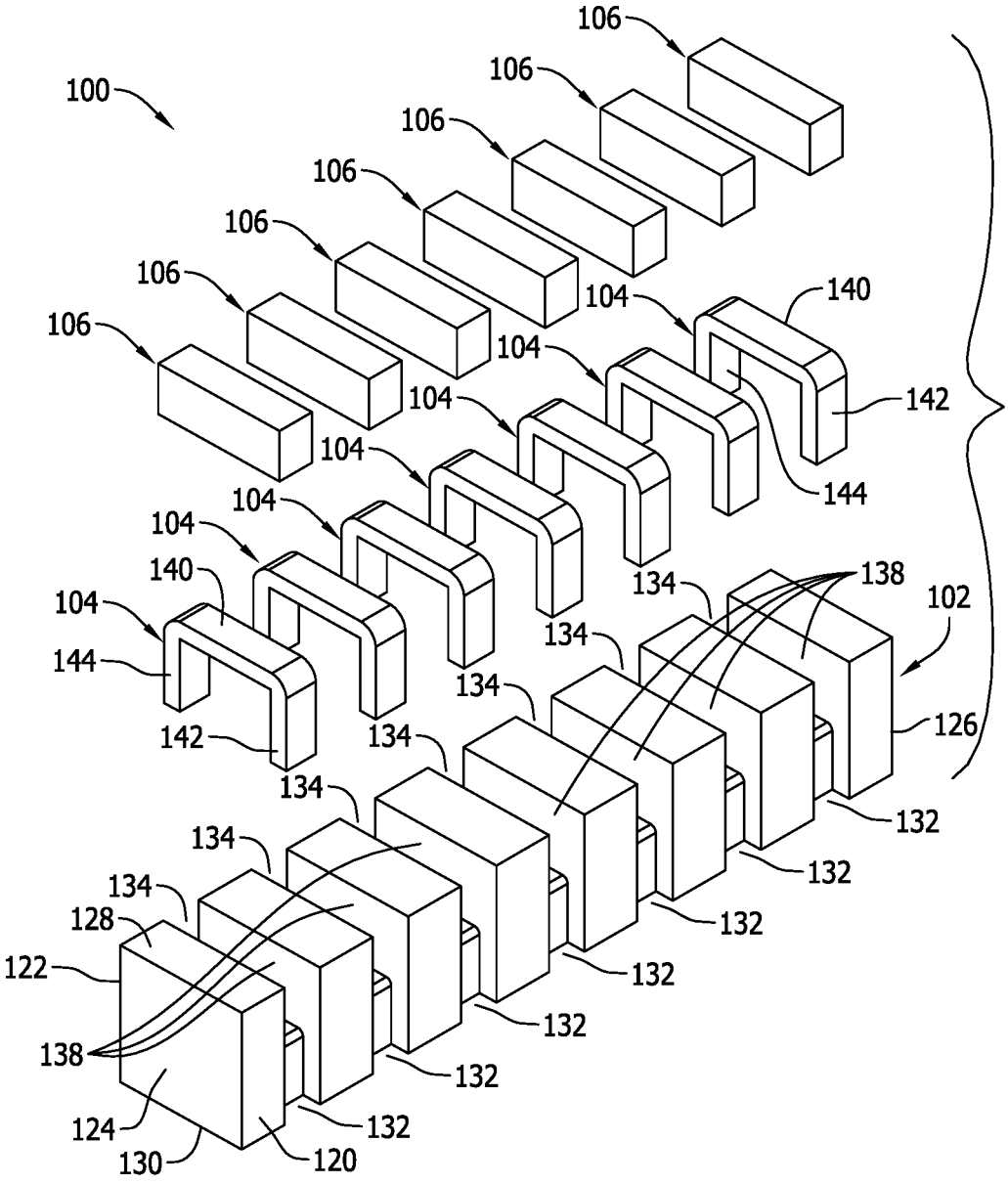
FIG. 1 is an exploded view of a first exemplary embodiment of a surface mount, power inductor component assembly.

Electromagnetic power inductors are known that include, for example, multiple windings integrated in a common core structure. Such inductor components are typically beneficial to provide multi-phase power regulation at a reduced cost relative to discrete inductor components including separate magnetic cores and windings for each respective phase of electrical power. As one example, a three phase power system can be regulated with an integrated power inductor component including three windings in the same magnetic core. Each winding is connected to one of the three phases of electrical circuitry on a circuit board. The integrated windings on a single core structure typically saves valuable space on the circuit board relative to providing one discrete inductor component for each phase including its own magnetic core. Such space savings can contribute to a reduction in size of the circuit board and also the electronic device including the circuit board.

Known integrated multi-phase power inductor component constructions are limited, however, in certain aspects and are therefore undesirable for application in certain types of electrical power systems. As such, existing power inductor constructions have yet to fully meet the needs of the marketplace in certain aspects.

Also, the manufacture and assembly of known integrated multi-phase power inductor components tends to involve multiple core pieces and fabrication steps to construct the magnetic core, including but not limited to steps associated with bonding of the multiple core pieces that increase the cost of manufacture and assembly for the components.

Saturation current ($I_{sat}$) performance tends to be limited by the magnetic core construction in known integrated multi-phase power inductor components. Improvement is desired for state of the art electrical power systems for higher powered electronic devices.

The form factor of known integrated multi-phase power inductor components, including the "footprint" (understood by those in the art as a reference to an area that the component occupies on a plane of the circuit board) and profile (understood by those in the art as a reference to the overall component height measured perpendicular to the plane of the circuit board) can effectively limit the ability of the component to perform in higher current, higher power system applications. Balancing the power demands of higher power circuitry with a desire for ever-smaller components is a challenge.

Finally, alternating current resistance (ACR) caused by fringing effect of integrated multi-phase power inductor component in use can be undesirably high in known component constructions.

Exemplary embodiments of integrated electromagnetic multi-phase power inductor component assemblies for power supply circuitry on a circuit board (i.e., power inductors) are described hereinbelow that overcome at least the disadvantages described above. The exemplary inductor component assemblies achieve this at least in part via a plurality of conductive windings assembled on a common magnetic core structure that includes magnetic gaps for improved magnetic performance. Distributed gap material may employed to define magnetic gaps that reduce, if not minimize, fringing flux in the core structure, and ACR caused by fringing effect is accordingly reduced. Higher power capability is provided with three dimensional conductive windings formed from planar conductive material and magnetic core structure that has a relatively small footprint in combination with a compact profile to accommodate higher power, higher current applications.

Figure 2:
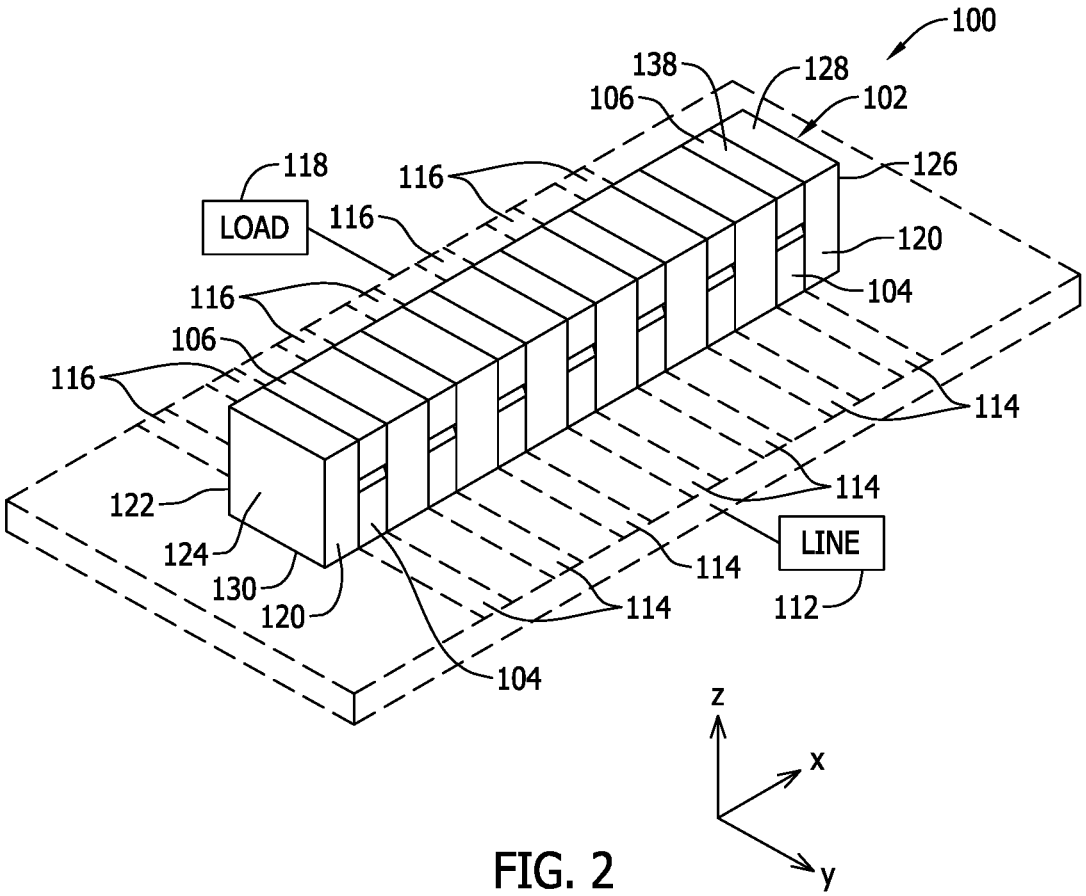
FIG. 2 is a top perspective of the assembled surface mount, power inductor component assembly shown in FIG. 1.
Figure 3:
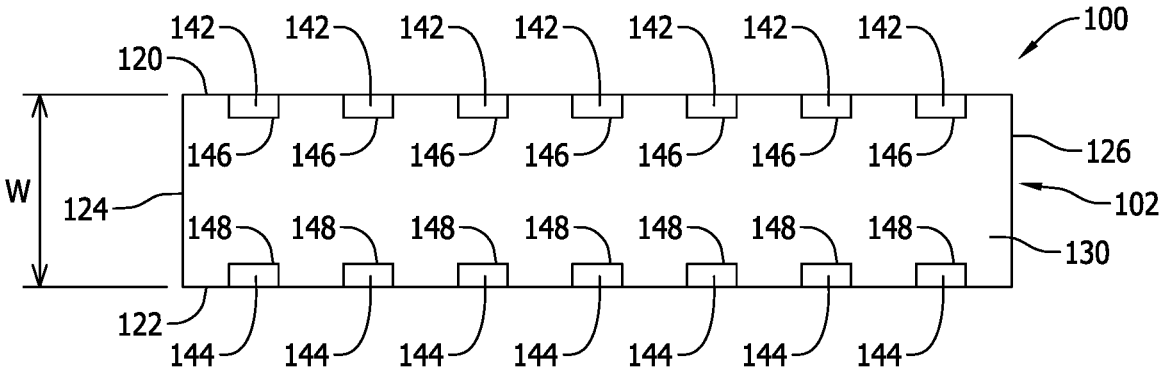
FIG. 3 is a bottom view of the surface mount, power inductor component assembly shown in FIG. 2.
Figure 4:
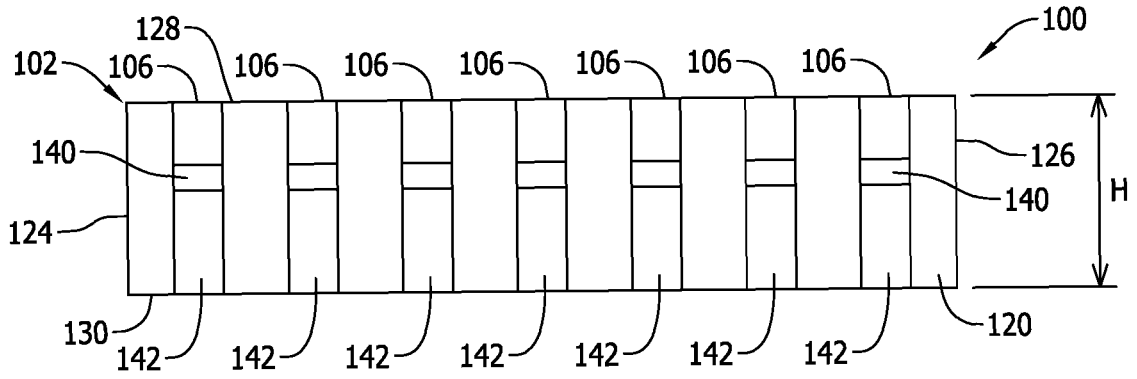
FIG. 4 is a side view of the surface mount, power inductor component assembly shown in FIG. 2.
Figure 5:
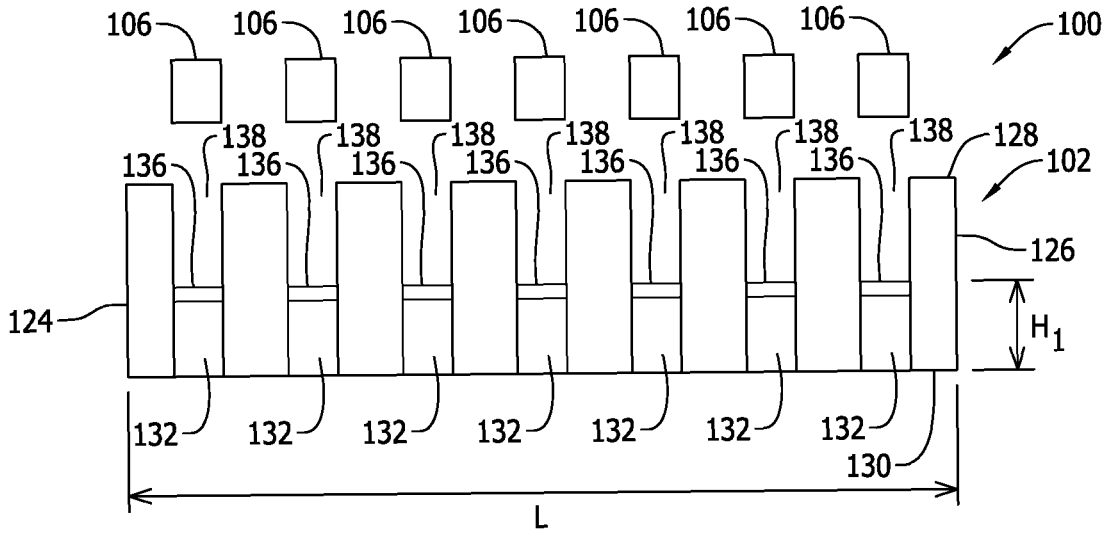
FIG. 5 is side assembly view of a portion of the surface mount, power inductor component assembly shown in FIG. 1.

FIGS. 1-5 illustrate various views of a first exemplary embodiment of a surface mount, power inductor component assembly 100. Specifically, FIG. 1 is an exploded view of a first exemplary embodiment of the surface mount, power inductor component assembly 100. FIG. 2 is a top perspective of the assembled surface mount, power inductor component assembly 100. FIG. 3 is a bottom view of the surface mount, power inductor component assembly 100. FIG. 4 is a side view of the surface mount, power inductor component assembly 100. FIG. 5 is side assembly view of a portion of the surface mount, power inductor component assembly 100.

The power inductor component assembly 100 generally includes, as shown in FIGS. 1-5, an integrated magnetic core piece 102 receiving a plurality of conductive windings 104, a distributed gap magnetic material 106 covering each winding 104 on the magnetic core piece 102, and a circuit board 110 (FIG. 2).

The circuit board 110 is configured with multi-phase power supply circuitry, sometimes referred to as line side circuitry 112, including conductive traces 114 provided on the plane of the circuit board 110 in a known manner. In the example shown, the line side circuitry 114 provides seven phase electrical power, and accordingly in contemplated embodiments each of the conductive traces 114 corresponds to a respective one of the seven phases of the multi-phase, line side power supply circuitry 112. In turn, each one of the windings 104 in the power inductor component assembly 100 is connected to one of the conductive traces 114 on the circuit board 110 and to the associated one of the seven phases of power supplied by the line side circuitry 112.

A second set of conductive traces 116 is also provided on the circuit board 110, with the windings 104 in the power inductor component assembly 100 completing an electrical connection between one of the conductive traces 114 and one of the conductive traces 116. The conductive traces 116 define load circuitry 118 on the circuit board 110. The line side circuitry 112 and the conductive traces 114 therefore provide a current input to the power inductor component assembly 100, while the power inductor component assembly 100 provide a current output to the conductive traces 116 and the load side circuitry 118. The load side circuitry 118 may accordingly power a seven phase electrical motor, for example, with the power inductor component assembly 100 providing regulated power output to the load side circuitry 118 in each phase. As needed or as desired, the line or load side circuitry 112, 118 may include power converter circuitry as desired to meet the needs of the electrical load and to provide appropriate power regulator circuitry and/or a power converter circuitry application on the board 110. As such power regulator and converter circuits are generally known and within the purview of those in the art, no further description of the circuitry is believed to be necessary.

While a seven phase power system is represented and the inductor component 100 is configured as a seven phase, integrated power inductor having seven windings 104, greater or fewer numbers of phases in the multi-phase power supply circuitry 112 may alternatively be provided, and a corresponding number of windings to the phases provided in another multi-phase power system may be included in another embodiment of the power inductor. For example, the power inductor component 100 may alternatively be configured for two phase power applications and therefore include two windings 104, a three phase power applications and therefore include three windings 104, or four or more windings for power systems including a corresponding number of windings 104. The integrated power inductor component design is generally scalable to include n number of windings for application in a power system having n number of windings.

The magnetic core piece 102 in an exemplary embodiment is fabricated as a single piece, integrally formed magnetic core using known magnetic materials and techniques. Fabrication of the magnetic core piece 102 as a single piece avoids process steps of having to assemble separate and discrete core pieces for each winding 104 needed as is common to some known types of power inductors. Relative to discrete inductor components mounted on the circuit board 110, the integrated magnetic core 102 that accommodates multiple windings 104 provides space savings on the circuit board 110.

In contemplated embodiments, the magnetic core piece 102 may be formed from soft magnetic particle materials utilizing known techniques such as molding of granular magnetic particles to produce the desired shape as shown and including the features further described below. Soft magnetic powder particles used to fabricate the core piece 102 may include Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, cobalt-based amorphous powder particles, and other suitable materials known in the art. Combinations of such magnetic powder particle materials may also be utilized if desired. The magnetic powder particles may be obtained using known methods and techniques and molded into the desired shape also using known techniques.

In the example shown, the magnetic core piece 102 is formed with opposing first and second longitudinal side walls 120 and 122, opposing first and second lateral side walls 124 and 126 interconnecting the first and second longitudinal side walls 120 and 122, and opposing top and bottom side walls 128 and 130 interconnecting the respective first and second longitudinal side walls 120 and 122 and the respective first and second lateral side walls 124 and 126. In the context of FIG. 1, the "bottom" wall 130 is located adjacent the circuit board 110 and the "top" wall 128 is located at some distance from the circuit board 110.

The magnetic core piece 102 including the generally orthogonal side walls 120, 122, 124, 126, 128 and 130 impart an overall rectangular or box-like shape to the core piece 102. The box-like shape of the core piece 102 in the illustrated example has an overall length L (FIG. 5) measured between the side walls 124, 126 and along a first dimensional axis such as an x axis of a Cartesian coordinate system (FIG. 2). The core piece 102 also has an overall width W (FIG. 3) measured between the side walls 120 and 122 along a second dimensional axis perpendicular to the first dimension axis such as a y axis of a Cartesian coordinate system (FIG. 2), and a height H (FIG. 4) measured between the top and bottom side walls 128 and 130 along a third dimensional axis extending perpendicular to the first and second dimensional axis such as a z axis of a Cartesian coordinate system (FIG. 2). In the example shown, the height H and the width W are approximately equal in dimension, while L is significantly larger than the height H and width W. The height H of the component 100 is relatively compact to provide a low profile component, while the width W and length L are accordingly compact considering the number of windings 104 provided.

The longitudinal side walls 120 and 122 each respectively include a series of spaced apart recesses or slots 132, 134 defining a series of respective winding channels on each of the longitudinal side walls 120 and 122. The recesses or slots 132, 134 extending generally perpendicular to the bottom side wall 130 and are respectively arranged in opposing pairs evenly spaced from one another along the axial length L of the core piece 102. The recesses or slots 132, 134 extend between the bottom side wall 130 and a shelf 136 extending intermediate the top side wall 128 and the bottom side wall 130 as best seen in FIG. 5. The shelf 136 extends as a coplanar surface having a height $H_1$ (FIG. 5) that is about ½ the height H (FIG. 4) of the remainder of the core piece 102 between the bottom side wall 130 and the top side wall 128.

A top recess or slot 138 extends above each portion of the shelf 136 such that a series of spaced apart slots 138 are seen in the top side wall 128 (FIGS. 1 and 5) to facilitate assembly of the windings 104. The slots 138 are formed in the top side wall 128 to extend transversely to the longitudinal side walls 120, 122 of the core piece and are evenly spaced from one another along the axial length L of the magnetic core piece 102. Each slot 138 extends generally perpendicular to one of the slots 132, 134 in the longitudinal side walls 120, 122, and the locations of the slots 138 in the top side wall 128 and each pair of recesses or slots 132, 134 define an inverted U-shaped cavity in the core structure for assembly of the windings 104.

Since seven windings 104 are included in the example shown, the magnetic core piece 102 includes seven slots 132 in the longitudinal side wall 120, seven slots 134 in the longitudinal side wall 122, and seven slots 138 in the top side wall 128 that respectively receive different portions of each winding 104 as described further below. The fabrication of the core piece 102 is relatively simple and may accordingly be provided at a relatively lower cost than conventional and relatively complicated core shapes.

As best shown in FIG. 1, each of the conductive windings 104 are formed as identically shaped and fabricated conductive elements. Each winding 104 is fabricated from a thin strip of conductive material that is bent or otherwise shaped or formed into the geometry shown. In the illustrated example, each winding 104 includes a straight or lineally extending planar main winding section 140 and first and second planar legs 142, 144 each extending perpendicular to the planar winding section 140 and opposing one another on the ends of the planar main winding section 140. As such, and in the illustrated example, the windings 104 are generally inverted U-shaped members with the section 140 being the base of the U and the legs 142, 144 extending downward from the section 140 for assembly to the core piece 102 via the slots 132, 134 and 138.

In the example shown, the legs 142, 144 are disproportionately shorter than the planar main winding section 140 of each winding 104. That is, the legs 142, 144 have a first axial length that is much shorter, and in the example shown about ½ of the axial length of the main winding section 140. The proportions of the winding legs 142, 144 facilitate a reduced profile (i.e., reduced height H) of the completed inductor component 100 on the circuit board 110 than may otherwise result if the winding legs 142, 144 were longer. The main winding sections 140 in each winding 104 is relatively large in the x, y plane to capably handle higher current, higher power applications beyond the limits of conventional electromagnetic component constructions of an otherwise similar size.

The U-shaped windings 104 are rather simply shaped and may be fabricated at low cost from a conductive sheet of material having a desired thickness into the three-dimensional shape as shown. The windings 104 may be fabricated in advance as separate elements for assembly with the core piece 102. That is, the windings 104 may be pre-formed in the U-shaped configuration as shown for later assembly with a core piece 102.

As seen in the Figures, each U-shaped winding 104 is inserted in the core piece 102 from the top side wall 128 via the top channels 138. When so inserted, each of the first and second legs 142, 144 in each winding 104 extends in respective ones of the slots 132, 134 in the longitudinal side walls 120, 122. The width of the material used to make the windings 104 fills the slots 132, 134 in the magnetic core piece 102, and the thickness of the material used to make the windings is about equal to the depth of the slots 132, 134 such that the winding legs 142, 144 are substantially flush with the outer surface of the longitudinal side walls 120, 124 as seen in FIGS. 2 and 3. In other words, the outer surface of each winding leg 142, 144 is generally coplanar with the outer surface of each longitudinal side wall 120, 122 in order to minimize the footprint of the component 100 on the circuit board 110. Each winding leg 142, 144 is exposed on the respective longitudinal side walls 120, 122.

The main winding section 140 of each winding 104 is seated upon the shelf 136 (FIG. 4) in the magnetic core piece 102 in a spaced relation from the top side wall 128 as each winding 104 is assembled to the magnetic core piece. Each of the inverted U-shaped windings 104 is easily assembled in one of the inverted U-shaped cavities defined in the core piece 102, but since the top slots 138 are much deeper than the slots 132, 134 in the longitudinal side walls 120, 124 the main winding section 140 of each winding 104 occupies only a small portion of the top slot 138 above the shelf 136 when the windings 104 are fully assembled to the magnetic core piece 102. The main windings 120 extend in a coplanar manner to one another once assembled to the core piece 102, and are axially spaced and separated from one another in the longitudinal dimension (the x dimension in the Cartesian coordinate system shown in FIG. 1) by a sufficient distance to avoid magnetic coupling of the main winding sections 140 to one another. Each winding 104 is therefore independently operable from the others in the component, referred to herein as non-coupled windings in the power inductor component 100 wherein none of the windings 104 are influenced by a magnetic field generated by another one of the windings 104 on the core piece 102. The power inductor component 100 is therefore distinguished from conventional inductor components having magnetically coupled windings that may desirable in alternative applications, but not in the multi-phase power inductor application described above.

As seen in FIGS. 1, 2, 4 and 5, the distributed gap material 106 fills the top slots 138 above the main winding section 140 of each winding 104, such that the planar main winding sections 140 are covered by the distributed gap material 106 on the top side. Unlike the fabricated core piece 102 described thus far, distributed gap magnetic material 106 is fabricated from magnetic powder particles that are coated with an insulating material such that the material 106 possesses so-called distributed gap properties familiar to those in the art and fabricated in a known manner. As such, in contemplated embodiments, the core piece 102 does not possess distributed gap properties, while the material 106 does. The distributed gap magnetic material 106 therefore exhibits different magnetic properties than the magnetic core piece 102 and defines a magnetic gap in the core structure for energy storage in use of the component 100.

In contemplated embodiments, the distributed gap material 106 may be applied in the top slots before or after the windings 104 are assembled to the core piece 102.

For example, in one embodiment the core piece 102 can be formed in a first molding stage with magnetic material that does not include distributed gap properties, and the distributed gap material 106 can be provided in a second molding stage after the remainder of the core piece 102 is formed in a contemplated embodiment. The core piece 102, including the distributed gap material 106, may therefore be provided for assembly with the windings 104.

Alternatively, the distributed gap material 106 may first be formed in the desired shape as seen in the drawings, with the core piece 102 overmolded around the material 106. The core piece 102 including the distributed gap material 106 may then be provided for assembly with the windings 104 on the magnetic core piece 102.

As another alternative, the windings 104 may be preformed and overmolded with the distributed gap material 106 in the desired shape as seen in the drawings and further described below, and the core piece 102 subsequently overmolded around the windings 104 and the distributed gap materials 106.

In the example shown, the distributed gap material 106 completely fills each of the top slots 138 above each main winding section 140 such that the distributed gap material 106 is substantially flush with the outer surface of the top side wall 128 and also the longitudinal side walls 120, 122 as shown in the Figures. The distributed gap materials 106 extending above each main winding section 140 provide for a series of spaced apart, effective magnetic gaps for energy storage in each winding 104 operating on one of the phases of a multi-phase power inductor application.

The magnetic gap provided by the distributed gap material 106 is centered on and aligned with each of the main winding sections 140. As such, the distributed gap material 140 in the slots 138 is aligned horizontally in the x, y plane with each respective one of the main winding sections 140. An axial centerline of each main winding section 140 in the horizontal plane (measured perpendicularly to the longitudinal side walls 120, 122 is aligned with an axial centerline of the distributed gap material 106 that covers each main winding section 140. The distributed gap materials 106 extends above each of the main windings 104 as a horizontal row of material having the same length (in the x direction of FIG. 2) and the same width (in they direction of FIG. 2) as each main winding section 140.

The distributed gap materials 106 in the respective slots 138 also extend to and are exposed on each of the top side wall 128 and the longitudinal side walls 120, 122 as seen in FIGS. 2, 4 and 5. The distributed gap materials 106 are further in direct, surface contact with the main winding section 140 of each winding 104. None of the distributed gap materials 106 extend between the main winding sections 140 in adjacent ones of the windings 104 on the magnetic core piece 102, and none of the distributed gap materials 106 extend between the winding legs 142, 144 in the exemplary component 100.

The component assembly 100 may be completed by turning the ends of the winding legs 142, 144 inwardly on the bottom side wall 130 to define surface mount termination pads 146, 148 (FIG. 3) for connection to the circuit board 110 (FIG. 2) and the conductive traces 114, 116. The surface mount pads 146, 148 may project from the bottom side wall 130 of the magnetic core piece 102 such that a space is created between the bottom side wall 130 and the circuit board 110 when the termination pads 146, 148 are connected to the circuit board 110. Additional components may be mounted in the space created to further improve density of components mounted on the board.

The exemplary inductor component assembly 100 is beneficial in at least the following aspects. The magnetic core 102 and windings 104 are rather simply shaped and facilitate a simplified assembly of the component and therefor lowers manufacturing cost. The component assembly 100 is operable with balanced inductance between the different phases of electrical power connected to each winding while still reliably operating in higher power, higher current applications. The distributed gap material 106 reduces, if not minimizes, fringing flux from in the core structure, and ACR caused by fringing effect is accordingly reduced in operation of the assembly 100. Higher power, higher current capability is provided with three dimensional conductive windings 104 formed from planar conductive material and relatively simple core structure that has a relatively small component profile. Saturation current ($I_{sat}$) performance is enhanced. The component assembly 100 may be manufactured at relatively low cost, yet offer performance that many conventional power inductors are incapable of delivering.

Figure 6:
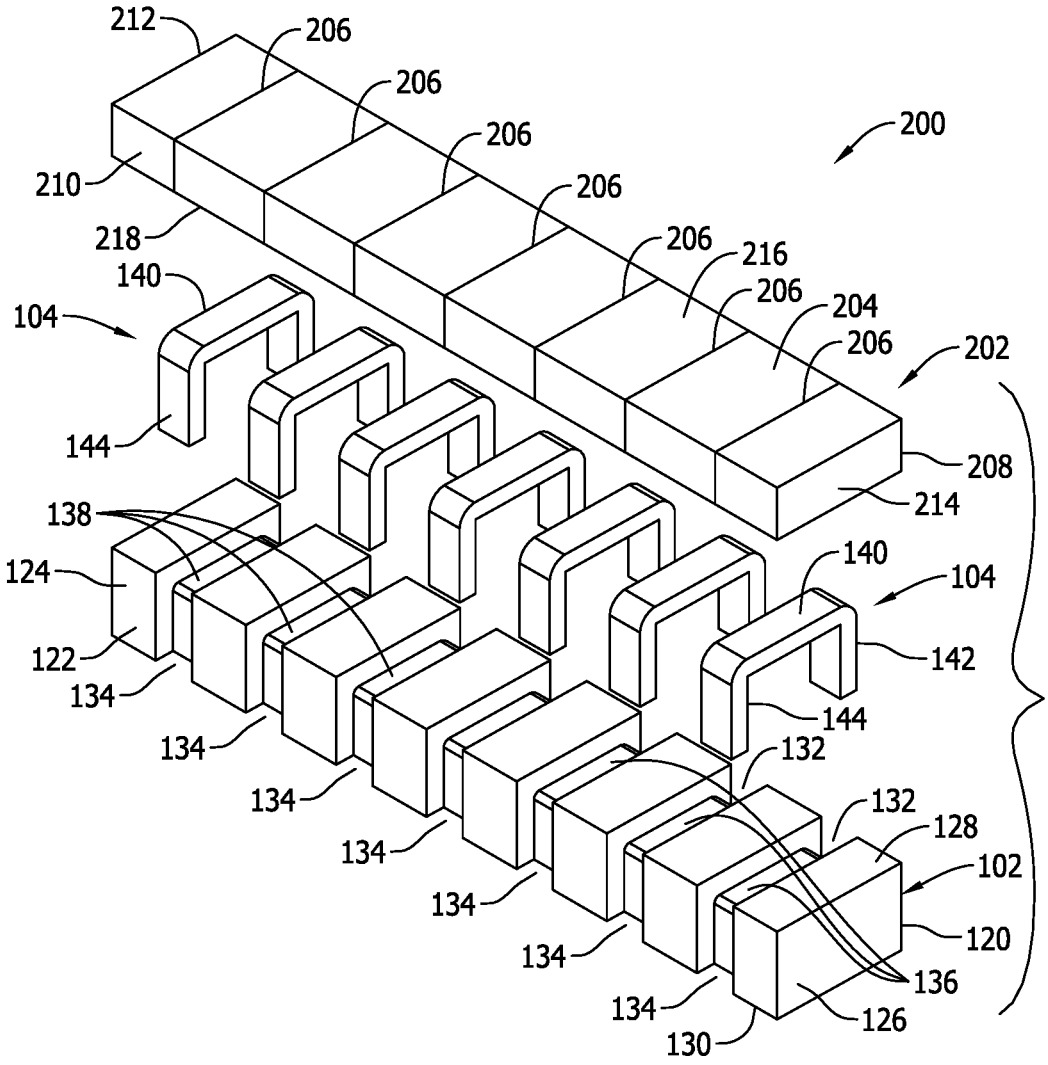
FIG. 6 is an exploded view of a second exemplary embodiment of a surface mount, power inductor component assembly.
Figure 7:
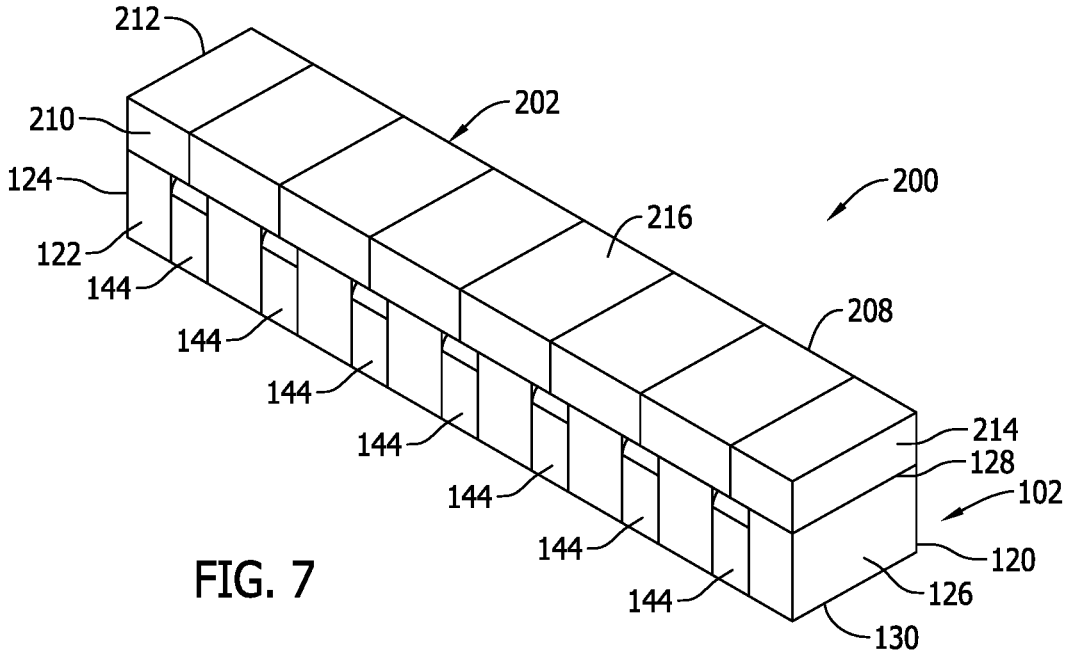
FIG. 7 is a top perspective of the assembled surface mount, power inductor component assembly shown in FIG. 6.
Figure 8:
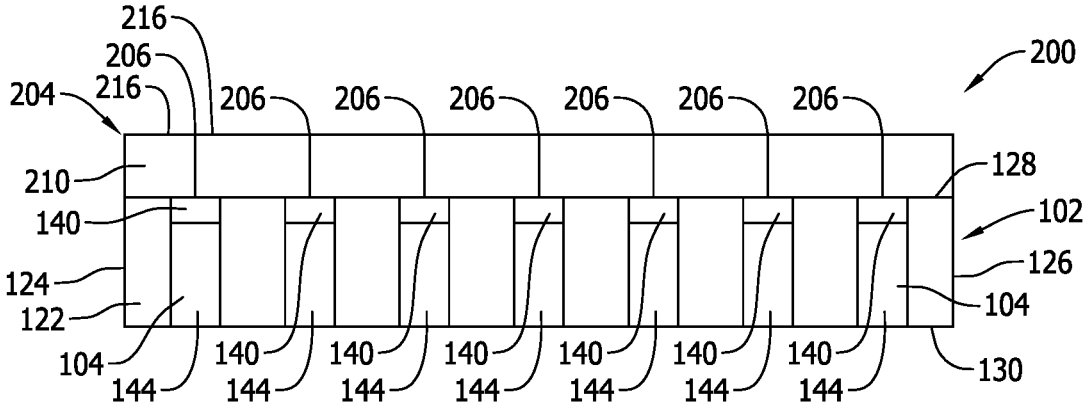
FIG. 8 is a side view of the assembled surface mount, power inductor component assembly shown in FIG. 7.
Figure 9:
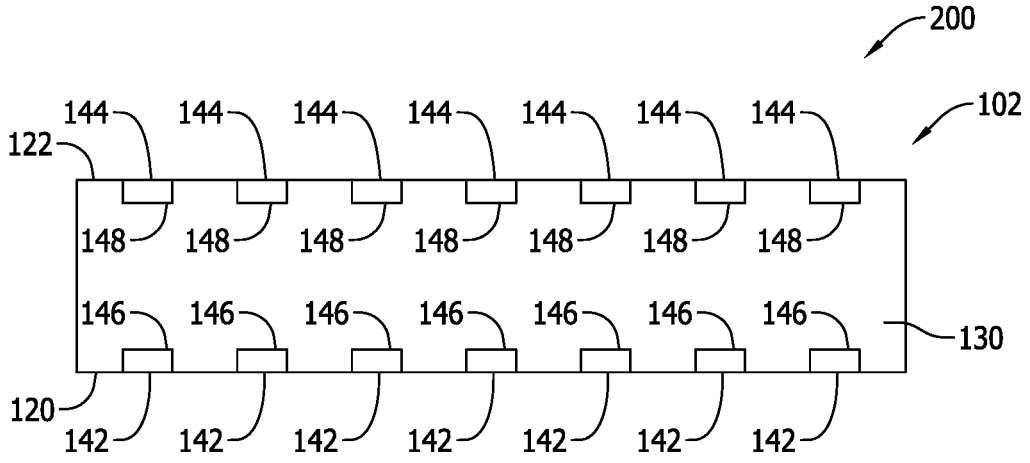
FIG. 9 is a bottom view of the assembled surface mount, power inductor component assembly shown in FIG. 7.

FIGS. 6-9 are various views of a second exemplary embodiment of a surface mount, power inductor component assembly 200 that may be used in lieu of the power inductor component assembly 100 on the circuit board 100 as described above. Specifically, FIG. 6 is an exploded view of the surface mount, power inductor component assembly 200. FIG. 7 is a top perspective of the assembled surface mount, power inductor component assembly 200. FIG. 8 is a side view of the surface mount, power inductor component assembly 200 shown in FIG. 7. FIG. 9 is a bottom view of the surface mount, power inductor component assembly 200.

Like the power inductor component 100, the power inductor component 200 includes the magnetic core piece 102 formed with the slots 134, 132 in the longitudinal side walls 122, 120 and the top slots 138 in the top side wall 128. The power inductor 200 likewise includes the windings 104 formed with the main winding sections 140 and the winding legs 142, 144. The windings 104 are assembled to the core piece 102 with the main winding sections 140 seated on the shelf 136 that extends below the top side wall 128 of the magnetic core piece 102. The windings 104 are arranged on the core piece 102 in a non-coupled manner as described above such that each winding 104 operates solely with respect to one of the phases of the multi=phase power supply circuitry 112 as described above.

In the component 200, however, the top channels 138 are shallow and are about the same depth as the thickness of the main winding section 140 in each winding, such that the main winding section 140 substantially fills each of the top slots 138 when the windings 104 are assembled to the magnetic core piece 102. The main winding sections 140 are therefore substantially flush with the top side wall 128 when the windings are assembled. In other words, a top side surface of the main windings sections extend in a coplanar relationship with the top surface of the core piece 102.

The power inductor component 200 further includes a magnetic core piece 202 assembled to the magnetic core piece 102 above the main winding sections 140 of the windings 104. The core piece 202 includes a magnetic body 204 and a series of spaced apart magnetic gaps in the form of distributed gap material 206. Each distributed gap material 206 is aligned with and centered on the main winding section 140 of each winding 104. Relative to the component 100, the distributed gap material 106 is much thinner in the direction of the x axis and extends over only a portion of the main winding section 140 of each winding 104. The axial centerline of the distributed gap material 106 remains aligned with the axial centerline of the distributed gap material 106 in the horizontal plane. As seen in FIG. 8, a vertical centerline of the distributed gap material 106 bisects the main winding section 140 of each winding 104, and also the winding legs 142, 144 of each of the windings 104, into two equal parts.

The magnetic core piece 202 includes longitudinal side walls 208 and 210, lateral side walls 212 and 214, and opposing top and bottom side walls 218 and 220. The distributed gap materials 206 in the example shown extend to the top and bottom side walls 216, 218 and each of the longitudinal sides 208 and 210. The bottom side wall 218 is flat and planar and may be bonded to the flat and planar top side wall 128 of the core piece 102, and the longitudinal side walls 208 and 210 and the lateral sides 212 and 214 of the core piece 202 align with the corresponding longitudinal and lateral side walls of the core piece 102 in the component 200.

The core body 204 including the distributed gap materials 206 can be prefabricated and provided for assembly with the magnetic core piece 102 after the windings 104 are assembled. The magnetic body 204 may include physical gaps that are filled with the distributed gap materials 206 or the body 204 may be molded with the distributed gap materials 206 in place. In an alternative embodiment, the magnetic body 204 may include magnetic gaps in the form of air gaps where ACR caused by fringing effect is not a primary concern.

Like the component 100, the component assembly 200 may be completed by turning the ends of the winding legs 142, 144 inward on the bottom side wall 130 of the core piece 102 as shown in FIG. 9.

The magnetic gaps in the form of distributed gap materials 206 extending only over the main winding sections 140 of the windings 104 provides enhanced magnetic performance while the windings 104 remain non-magnetically coupled in the magnetic core structure of the component 200. The distributed gap material 206, in combination with the magnetic body 204 that is not fabricated from a distributed gap material, provides similar effective magnetic gaps and the performance enhancements described above in an alternative construction to the component 100. Because the core piece 202 including the magnetic gaps can be prefabricated, fabrication and assembly of the component 200 may be simplified further relative to the component 100.

Figure 10:
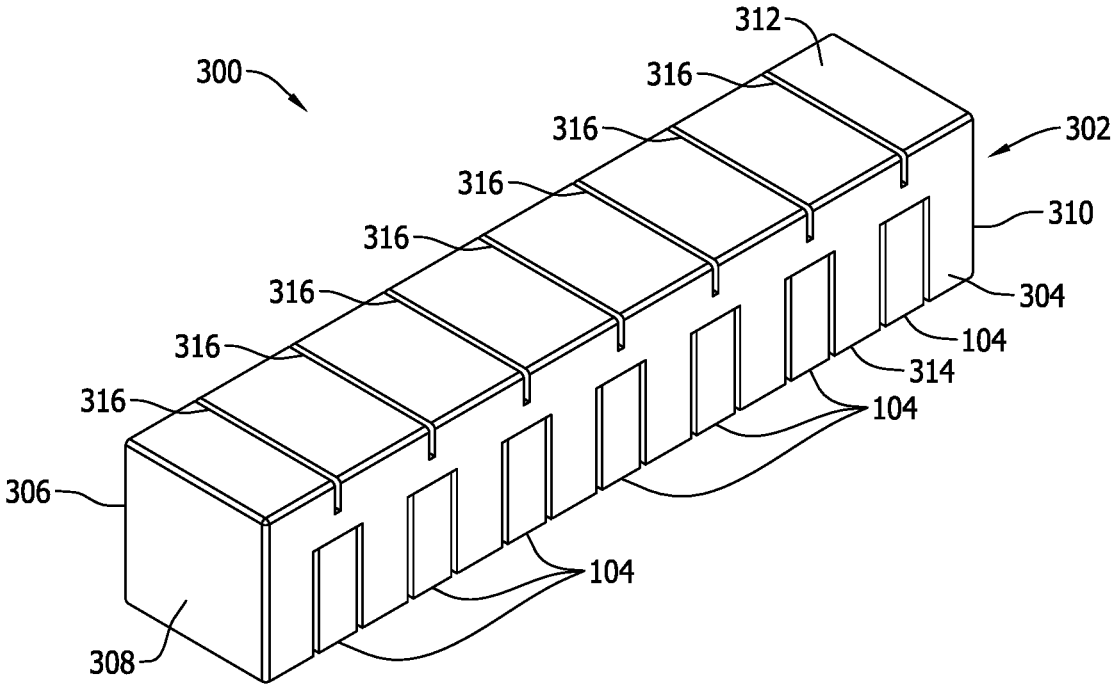
FIG. 10 is a top perspective of a third exemplary embodiment of a surface mount, power inductor component assembly.
Figure 11:
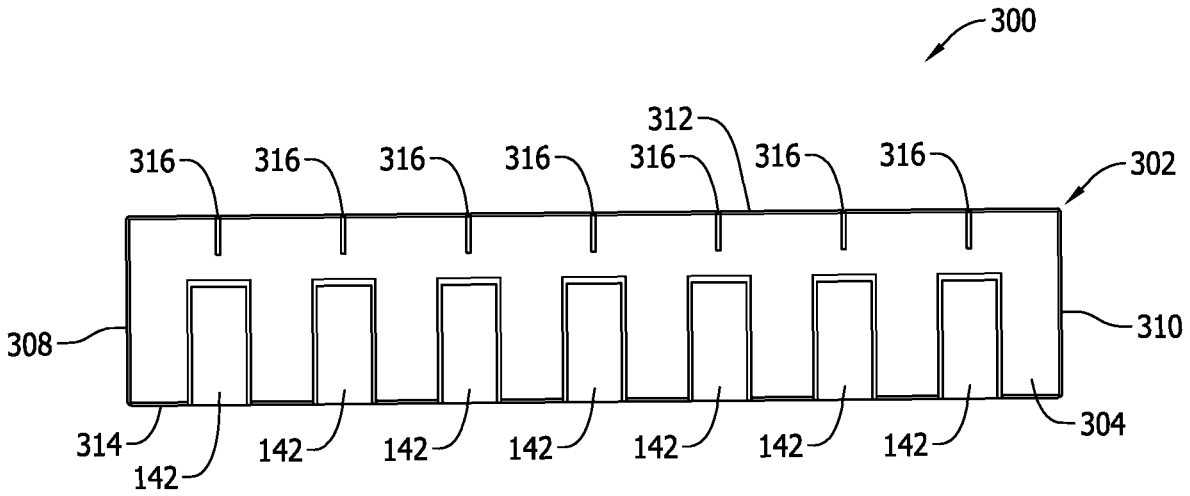
FIG. 11 is a side view of the assembled surface mount, power inductor component assembly shown in FIG. 10.
Figure 12:
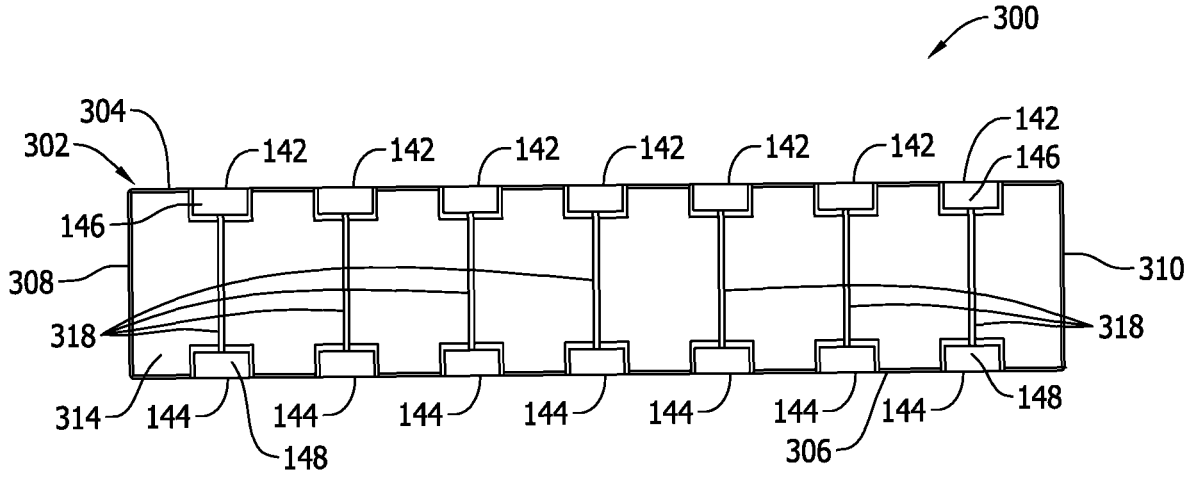
FIG. 12 is a bottom view of the assembled surface mount, power inductor component assembly shown in FIG. 10.

FIGS. 10-12 are various views of a third exemplary embodiment of a surface mount, power inductor component assembly 300. Specifically, FIG. 10 is a top perspective of a third exemplary embodiment of a surface mount, power inductor component assembly 300. FIG. 11 is a side view of the assembled surface mount, power inductor component assembly 300. FIG. 12 is a bottom view of the assembled surface mount, power inductor component assembly 300.

In the component 300, the windings 104 are assembled on a single piece magnetic core 302 including longitudinal side walls 304 and 306, lateral side walls 308 and 310, and top and bottom side wall walls 312 and 314. The windings are separated from one another in the magnetic core structure to avoid any coupling of adjacent windings 104 in use, and instead the windings 104 operate solely with respect to one phase of a multi-phase power supply as described above.

As shown in FIGS. 10 and 11, a first set of spaced apart physical gaps 316 is formed in the top side wall 312 and each of the gaps 316 extend to each of the longitudinal side walls 304 and 306. The first set of physical gaps 316 is aligned with and centered on each of the main winding sections 140 of the windings 104 in a similar manner to the magnetic gaps in the component 200. Furthermore, each physical gap 316 extends only part of the vertical distance from the top side wall 312 to the main winding section 140 of each winding 104 as shown in FIGS. 10 and 11. As such, each physical gap 316 extends above, but is spaced from, each main winding section 140 of each winding 104. In other words, each physical gap 316 is open to the top side wall 312 of the single piece magnetic core 302 but has a depth that is only about ½ of the vertical distance between the top side wall 302 and the main winding section 140 of each winding. The width and depth of the physical gaps 316 may be varied from the examples shown in FIGS. 10 and 11 in other embodiments.

As shown in FIG. 12, a second set of spaced apart physical gaps 318 is formed in the bottom side wall 314 and each of the gaps 318 extends aligned with and centered on each of the main winding sections 140 of the windings 104. Each physical gap 318 extends beneath the main winding section 140 and between the winding legs 142, 144. Each gap 318 may be spaced from the main winding section in a similar manner to the gaps 316 on the opposing side of each main winding section 140.

In the example shown, each of the physical gaps 316, 318 are air gaps and as such the component 300 does not include distributed gap material. Because there are gaps on both sides of the main winding section 140 in the component 300, the component 300 may still perform well in higher current, high power circuitry. In a further embodiment, the physical gaps 316, 318 may be filled with a magnetic or non-magnetic material to provide still further performance variations.

The component assembly 300 may be completed by turning the ends of the winding legs 142, 144 inward on the bottom side wall 314 of the core piece 302 as shown in FIG. 12.

Relative to the components 100 and 200, the single piece core 302 and the absence of distributed gap materials 106 further facilitates assembly at lower cost, although the windings 104 may no longer be assembled to the core piece from the top side and instead must be inserted through the longitudinal sides and thereafter formed into the inverted U-shape, such that installation of the windings 104 is a bit more complicated.

Any of the inductor components 100, 200, 300 may also be configured as swing-type inductor component wherein the core structure can be operated almost at magnetic saturation under certain current loads with the inductance at a maximum level for a predetermined range of relatively small currents, while the inductance changes or swings to a lower value for another range of relatively higher currents. By varying the magnetic gap characteristics in the core structures, the inductor components 100, 200, 300 may be operable to achieve a higher OCL (open circuit inductance) value at light load and a lower OCL at full load to improve operating efficiency while maintaining a substantially constant ripple current in use.

Such swing-type inductor components are sometimes utilized in a filter circuit of a power supply that converts alternating current (AC) at a power supply input to direct current (DC) at a power supply output. Such converter circuitry may be commonly employed with or provided in combination with electronic devices of all kinds. In other applications, swing-type inductor components may be utilized in regulated, switching power supply circuitry of, for example, modern electronic devices of all kinds.

The advantages and benefits of the present invention are now believed to have been amply illustrated in relation to the exemplary embodiments disclosed.

An embodiment of an inductor component assembly has been disclosed including a plurality of conductive windings each comprising a planar main winding section and opposing winding legs extending perpendicularly from the planar main winding section, and an integrated magnetic core structure accepting each of the plurality of conductive windings in a spaced apart, non-magnetically coupled arrangement with respect to one another. The integrated magnetic core structure includes a series of magnetic gaps each being respectively centered on one of the planar main winding sections, and the ends of the opposing winding legs are turned inwardly on a bottom side wall of the integrated magnetic core structure to define surface mount terminations for connection to a circuit board.

Optionally, the integrated magnetic core structure may include a magnetic core piece including a top side wall and a shelf extending below the top side wall to receive each respective one of the plurality of conductive windings in a spaced relation from the top side wall, and the magnetic gap may include a distributed gap material extending from each planar main winding section to the top side wall. The magnetic core piece may further include longitudinal side walls, wherein the distributed gap material extends to each of the longitudinal side walls.

Also optionally, the magnetic core structure comprises a first magnetic core piece may be configured to accept the plurality of conductive windings, and a second magnetic core piece may be provided that includes the series of magnetic gaps each respectively centered on one of the planar main winding sections. The main winding section of each of the plurality of conductive windings may be substantially flush with a top side wall of the first magnetic core piece, and the second magnetic core piece may overlie the top side wall of the first magnetic core piece.

As another option, the magnetic core structure may be a single core piece including the series of magnetic gaps each respectively centered on one of the planar main winding sections. The series of magnetic gaps may include a first series of magnetic gaps extending on a top side wall of the single magnetic core piece above the main winding section of each winding, and a second series of magnetic gaps extending on a bottom side wall of the single magnetic core below the main winding section of each winding. The series of magnetic gaps may include air gaps.

The magnetic core structure may include opposed longitudinal side walls and a series of slots in each of the longitudinal side walls, each of the series of slots receiving a respective one of the winding legs of a respective one of the plurality of conductive windings. Each of the winding legs in the plurality of conductive windings may be exposed on one of the longitudinal side walls.

The plurality of conductive windings may include seven conductive windings. The series of magnetic gaps may include air gaps or filled physical gaps. The filled physical gaps may include a distributed gap material filling the physical gaps.

The series of magnetic gaps may be respectively spaced from the main winding section in the magnetic core structure. The surface mount terminations may project from the bottom side wall. The series of magnetic gaps may include magnetic gaps extending beneath the main winding section of each conductive winding.

The magnetic structure may include a top side wall and the planar main winding sections in each of the plurality of conductive windings may extend coplanar to one another in a spaced apart relationship from the top side wall. The magnetic core structure may define a respective slot for each of the main winding sections, and an entirety of the main winding section may be received in each slot. An axial length of the winding legs is less than an axial length of the main winding section in each of the plurality of windings, and the inductor component may define a power inductor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An inductor component assembly comprising:

a plurality of conductive windings each comprising a planar main winding section and opposing winding legs extending perpendicularly from the planar main winding section;

an integrated magnetic core structure accepting each of the plurality of conductive windings in a spaced apart, non-magnetically coupled arrangement with respect to one another;

wherein the integrated magnetic core structure includes a series of magnetic gaps, each gap in the series of magnetic gaps being respectively centered on one of the planar main winding sections and varying the respective magnetic gap characteristics of the integrated magnetic core structure on opposing sides of the planar main winding sections, and at least one gap in the series of magnetic gaps extends only part of a distance between the at least one conductive winding and an outer wall of the integrated magnetic core structure;

wherein the ends of the opposing winding legs are turned inwardly on a bottom side wall of the integrated magnetic core structure to define surface mount terminations for connection to a circuit board; and wherein the inductor component assembly is operable as a swing inductor component where the integrated magnetic core structure operates with a high inductance level in a first range of low current conditions and operates with a low inductance level in a second range of high current conditions.

2. The inductor component assembly of claim 1, wherein the integrated magnetic core structure is a single magnetic core piece including the series of magnetic gaps.

3. The inductor component assembly of claim 2, wherein the series of magnetic gaps includes a first series of magnetic gaps extending on a top side wall of the single magnetic core piece above the main winding section of each of the plurality of conductive windings, and a second series of magnetic gaps extending on a bottom side wall of the single magnetic core piece below the main winding section of each of the plurality of conductive windings.

4. The inductor component assembly of claim 2, wherein the first or second series of magnetic gaps includes air gaps.

5. The inductor component of claim 1, wherein the integrated magnetic core structure includes opposed longitudinal side walls and a series of slots in each of the longitudinal side walls, each of the series of slots receiving a respective one of the winding legs of a respective one of the plurality of conductive windings.

6. The inductor component of claim 5, wherein each of the winding legs in the plurality of conductive windings is exposed on one of the longitudinal side walls.

7. The inductor component of claim 1, wherein the plurality of conductive windings includes seven conductive windings.

8. The inductor component of claim 1, wherein the series of magnetic gaps includes air gaps or filled physical gaps.

9. The inductor component of claim 1, wherein the series of magnetic gaps are respectively spaced from the main winding section of each of the plurality of conductive windings in the integrated magnetic core structure.

10. The inductor component of claim 1, wherein the surface mount terminations project from the bottom side wall.

11. The inductor component of claim 1, wherein the series of magnetic gaps include magnetic gaps extending beneath the main winding section of each of the plurality of conductive windings.

12. The inductor component of claim 1, wherein the integrated magnetic core structure includes a top side wall and the planar main winding sections in each of the plurality of conductive windings extend coplanar to one another in a spaced apart relationship from the top side wall.

13. The inductor component of claim 12, wherein the integrated magnetic core structure defines a respective slot for each of the main winding sections in the plurality of conductive windings, and an entirety of the main winding section being received in each slot.

14. The inductor component of claim 12, wherein an axial length of the winding legs is less than an axial length of the main winding section in each of the plurality of conductive windings.

15. The inductor component of claim 1, wherein the inductor component assembly defines a power inductor.

16. An inductor component assembly comprising:

a plurality of conductive windings each comprising a planar main winding section, opposing winding legs extending perpendicularly from the planar main winding section and surface mount terminations extending from the respective opposing winding legs for connection to a circuit board;

an integrated magnetic core structure accepting each of the plurality of conductive windings in a spaced apart, non-magnetically coupled arrangement with respect to one another;

wherein the integrated magnetic core structure includes a plurality of magnetic gaps each being respectively centered on one of the planar main winding sections and at least one of the plurality of gaps extending only part of a distance between the at least one conductive winding and an outer wall of the integrated magnetic core structure, the plurality of magnetic gaps arranged to vary the magnetic gap characteristics of the integrated magnetic core structure on a first side of the planar main winding sections from a second side of the planar main winding sections opposing the first side; and wherein the integrated magnetic core structure operates with a high inductance level in a first range of low current conditions and swings to a low inductance level in a second range of high current conditions.

17. A swing-type inductor component assembly comprising:

at least one conductive winding comprising a planar main winding section, opposing winding legs extending perpendicularly from the planar main winding section and surface mount terminations extending from the respective opposing winding legs for connection to a circuit board; and a magnetic core structure accepting the at least one conductive winding, the magnetic core structure formed with at least one magnetic gap that extends only part of a distance between the at least one conductive winding and an outer wall of the magnetic core structure;

wherein the magnetic core structure operates with a high inductance level in a first range of low current conditions and operates with a low inductance level in a second range of high current conditions.

18. The inductor component assembly of claim 17, wherein the at least one magnetic gap is centered on the planar main winding section.

19. The inductor component assembly of claim 18, wherein the at least one conductive winding includes a plurality of conductive windings that each include a planar main winding section, opposing winding legs extending perpendicularly from the planar main winding section and surface mount terminations extending from the respective opposing winding legs for connection to a circuit board.

20. The inductor component assembly of claim 19, wherein the magnetic core structure is a single piece, integrated magnetic core structure accepting each of the plurality of conductive windings in a spaced apart, non-magnetically coupled arrangement with respect to one another.

21. The inductor component assembly of claim 20, wherein the integrated magnetic core includes a series of magnetic gaps respectively associated with one of the plurality of conductive windings, whereby the integrated magnetic core structure is operable with a high inductance level in a first range of low current conditions for each of the plurality of conductive windings and to operate with a low inductance level in a second range of high current conditions for each of the plurality of conductive windings.

* * * * *